US010301577B2

(12) United States Patent
Graf et al.

(10) Patent No.: US 10,301,577 B2
(45) **Date of Patent: *May 28, 2019**

(54) COMPOSITION

(71) Applicant: Reckitt Benckiser N.V., Hoofddorp (NL)

(72) Inventors: Nicole Graf, Sinsheim (DE); Karlheinz Ulrich Gerhard Hahn, Ludwigshafen (DE)

(73) Assignee: RECKITT BENCKISER FINISH B.V., Hoofddorp (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/814,711

(22) Filed: Jul. 31, 2015

(65) Prior Publication Data

US 2015/0337242 A1 Nov. 26, 2015

Related U.S. Application Data

(63) Continuation of application No. 14/116,840, filed as application No. PCT/GB2012/051030 on May 11, 2012, now Pat. No. 9,096,816.

(30) Foreign Application Priority Data

May 12, 2011 (GB) ..... 1107885.4

(51) Int. Cl.

| | |
|---|---|
| ***C11D 3/00*** | (2006.01) |
| ***C11D 3/37*** | (2006.01) |
| ***C11D 17/04*** | (2006.01) |
| ***C11D 11/00*** | (2006.01) |
| ***C11D 3/30*** | (2006.01) |

(52) U.S. Cl.

CPC ..... *C11D 3/3765* (2013.01); *C11D 3/0073* (2013.01); *C11D 3/30* (2013.01); *C11D 3/3723* (2013.01); *C11D 3/3769* (2013.01); *C11D 3/3796* (2013.01); *C11D 11/0023* (2013.01); *C11D 11/0035* (2013.01); *C11D 17/042* (2013.01)

(58) Field of Classification Search

CPC ..... C11D 3/3765
USPC ..... 510/219; 252/175
See application file for complete search history.

(56) References Cited

U.S. PATENT DOCUMENTS

| | | | | |
|---|---|---|---|---|
| 2,182,306 | A * | 12/1939 | Ulrich | C08G 73/0213 528/424 |
| 3,033,746 | A * | 5/1962 | Moyle | C07D 277/64 106/18 |
| 3,255,117 | A | 6/1966 | Knapp et al. | |
| 3,677,820 | A | 7/1972 | Rutkowski | |
| 5,904,735 | A * | 5/1999 | Gutierrez | C11D 3/38609 510/320 |
| 6,569,261 | B1 * | 5/2003 | Aubay | C11D 3/37 134/38 |
| 6,593,288 | B2 * | 7/2003 | Aubay | C11D 3/3769 134/42 |
| 6,703,358 | B1 * | 3/2004 | Aubay | C11D 3/042 510/229 |
| 6,750,186 | B2 * | 6/2004 | Black | C11D 1/72 134/42 |
| 6,767,410 | B2 * | 7/2004 | Aubay | C11D 3/3769 134/42 |
| 7,736,525 | B2 * | 6/2010 | Thankachan | C08G 65/2624 210/766 |
| 8,852,353 | B2 | 10/2014 | Oberlander | |
| 2003/0083223 | A1 | 5/2003 | Aubay | |
| 2003/0108503 | A1 | 6/2003 | Maubru et al. | |
| 2003/0203826 | A1 | 10/2003 | Aubay | |
| 2008/0032911 | A1 | 2/2008 | Becker et al. | |
| 2009/0048143 | A1 | 2/2009 | Iverson et al. | |
| 2009/0324964 | A1 | 12/2009 | Scott et al. | |
| 2012/0073773 | A1 | 3/2012 | Jehn-Rendu et al. | |
| 2012/0138089 | A1 | 6/2012 | Ugh et al. | |

FOREIGN PATENT DOCUMENTS

| | | | | |
|---|---|---|---|---|
| CA | 2411028 | A1 * | 12/2001 | C03C 23/0075 |
| CN | 101821371 | A | 9/2010 | |
| EP | 0383480 | A1 | 8/1990 | |
| EP | 0383482 | A2 | 8/1990 | |
| EP | 0387997 | A2 | 9/1990 | |
| FR | 2796391 | A1 | 1/2001 | |
| JP | 2004100112 | A | 4/2004 | |
| RU | 2216307 | C1 | 11/2003 | |
| TW | 200810923 | A | 3/2008 | |
| WO | 9905248 | A1 | 2/1999 | |
| WO | WO 9905248 | A1 * | 2/1999 | C11D 3/0073 |
| WO | 03018650 | A1 | 3/2003 | |
| WO | 2004106476 | A1 | 12/2004 | |

(Continued)

OTHER PUBLICATIONS

Chinese Office Action dated Dec. 19, 2014 for Chinese patent application 201280022668.5.

Search Report in related Chinese Patent Application No. 201280022668.5, dated Dec. 19, 2014.

International Search Report dated Feb. 11, 2013 for priority application PCT/GB2012/051030.

*Primary Examiner* — Nicole M. Buie-Hatcher

*Assistant Examiner* — M. Reza Asdjodi

(74) *Attorney, Agent, or Firm* — Troutman Sanders LLP; Ryan Schneider; Chris Davis

(57) ABSTRACT

The present invention provides the use of a composition comprising a polyalkyleneimine and/or salts or derivative thereof and an amphoteric polymer for the prevention of corrosion of non-metallic inorganic items during a washing or rinsing process, in particular during an automatic dishwashing process.

8 Claims, No Drawings

(56) References Cited

FOREIGN PATENT DOCUMENTS

| | | | | | |
|---|---|---|---|---|---|
| WO | 20060029793 | A1 | | 3/2006 | |
| WO | 2007022235 | A1 | | 2/2007 | |
| WO | 20070054126 | A1 | | 5/2007 | |
| WO | 20070111892 | A2 | | 10/2007 | |
| WO | 2008007590 | A1 | | 1/2008 | |
| WO | 2010020765 | A1 | | 2/2010 | |
| WO | WO 2010020765 | A1 | * | 2/2010 | ..... C11D 3/0073 |
| WO | 20100145956 | A1 | | 12/2010 | |
| WO | 2011002476 | A1 | | 1/2011 | |

* cited by examiner

COMPOSITION

CROSS-REFERENCE TO RELATED APPLICATIONS

This application is a Continuation of U.S. application Ser. No. 14/116,840, filed 31 Jan. 2014, which is a U.S. National Stage of International Application No. PCT/GB2012/051030, filed 11 May 2012, which claims the benefit of GB 1107885.4, filed 12 May 2011, all of which are herein fully incorporated by reference as if fully set forth below.

BACKGROUND OF THE INVENTION

1. Field of the Invention

The present invention relates to an improved composition for use in the protection of non-metallic inorganic materials such as glassware in an automatic ware washing machine, preferably a dishwashing process.

2. Description of Related Art

The problem of corrosion of non-metallic inorganic items, such as glassware, ceramic and enamel materials, when subjected to automatic dishwashing processes is well recognised in the art. For example, it has been proposed that the problem of glassware corrosion is the result of two separate phenomena. Firstly, it has been suggested that the corrosion is due to leakage of minerals from the glass network, accompanied by hydrolysis of the silicate network. Secondly, it is proposed that the silicate material is then released from the glass.

These phenomena can cause damage to glassware after a number of separate wash cycles. The damage may include cloudiness, scratches, streaks and other discoloration/detrimental effects.

Silicate materials have been proposed as agents that are effective in preventing materials from being released by the glass composition. However, the use of silicate compounds can have detrimental side effects, such as the tendency to increase separation of silicate material at the glass surface.

A further solution has been to use metals such as zinc, either in metallic form (such as described in U.S. Pat. No. 3,677,820) or in the form of compounds. The use of soluble zinc compounds in the prevention of glassware corrosion in a dishwasher is described in, for example, U.S. Pat. No. 3,255,117.

European Patents EP-A-0 383 480, EP-A-0 383 482 and EP-A-0 387 997) describe the use of water insoluble compounds including zinc silicate, zinc carbonate, basic zinc carbonate ($Zn_2(OH)_2CO_3$), zinc hydroxide, zinc oxalate, zinc monophosphate ($Zn_3(PO_4)_2$) and zinc pyrophosphate ($Zn_2P_2O_7$) for this purpose.

Bismuth has been used as an additive to aid the prevention of corrosion of glazed glassware corrosion. For example, BE 860180 describes the use of bismuth to avoid damage of deco-rated, glazed articles.

The value of bismuth in this purpose has been diminished by the detrimental effects that the use of bismuth compound has on other components of the washing process or detergent composition. In soluble bismuth compounds can cause the formation of stains on kitchen-ware items e.g. glassware and cutlery which come into contact with these compounds. For these reasons the use of bismuth alone as a glaze protector has been avoided, although a combination of zinc and bismuth has been found to address this issue (see WO-A-04/106476).

However, it has been found that the use of heavy metal compounds in some circumstances reduce the bleaching performance of a dishwashing composition on bleachable stains such as tea stains. Furthermore, for environmental reasons, it is becoming increasingly desirable to limit (and especially to avoid) the use of heavy metals in detergent formulations.

WO2010/020765 proposed a solution to this problem of glass and tableware erosion that did not require the use of heavy metals. This document, which is hereby incorporated by reference, disclosed that polyalkyleneimines were highly effective additives for the prevention of corrosion of non-metallic inorganic items in automatic washing machines.

However, further to this, it has since been found that while the polyalkyleneimines do improve the corrosion protection their use has unexpectedly been found to cause poor rinse performance. This leads to unattractive spotting on glassware.

It is the object of the present invention to overcome the poor rinse performance that accompanies the use of polyalkyleneimine formulations.

BRIEF SUMMARY OF THE INVENTION

In a first aspect of the present invention there is provided a composition comprising a polyalkyleneimine and at least one amphoteric polymer.

According to one embodiment, the polyalkyleneimine preferably comprises a polyethyleneimine and most preferably it is polyethyleneimine.

According to one embodiment the number average molecular weight of the polyalkyleneimine and/or salt or derivative thereof is in the range of from 100 to 5,000,000.

According to one embodiment the at least one amphoteric polymer is a hydrophilic polymer.

According to another embodiment the at least one amphoteric polymer is an aqueous based acrylic acid amine-functional polymer.

According to another embodiment the at least one amphoteric polymer is a quaternized ammonium acryl amide acrylic acid copolymer.

According to another embodiment the at least one amphoteric polymer is produced by Rhodia and sold under the trade name Mirapol Surf S P-free powder.

According to one embodiment of the present invention the composition used is an automatic dishwashing composition comprising the polyalkyleneimine and/or salt or derivative thereof in an amount of from 0.0001 wt % to 50 wt % of the composition.

According to another embodiment the composition used is an automatic dishwashing rinse aid comprising the polyalkyleneimine and/or salt or derivative thereof in an amount of from 0.0005 wt % to 70 wt % of the composition.

According to yet another embodiment the composition used is a water softening salt composition comprising the polyalkyleneimine and/or salt or derivative thereof in an amount of from 0.0001 wt % to 90 wt % of the composition.

According to another embodiment of the present invention, the composition is used in a method of automatic ware washing, comprising supplying the composition to an automatic ware washing machine and washing wares in the machine. In some further embodiments, the automatic ware washing machine is an automatic dishwasher. In still other embodiments, the composition is used in a method of automatic ware washing comprising washing glassware in an automatic dishwasher. In still further embodiments, the composition is released into either a wash cycle or a rinse cycle, or alternatively both the wash and rinse cycles, of the automatic ware washing machine. In some embodiments, the method of automatic ware washing uses a composition comprising 0.01 mg to 10 g of the amphoteric polymer and 0.01 mg to 10 g of the polyalkyleneimine per wash or rinse cycle of the automatic ware washing machine.

These and other objects, features and advantages of the present invention will become more apparent upon reading the following specification.

DETAILED DESCRIPTION OF PREFERRED EMBODIMENTS

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

It has been found that the rinse problems of the compositions caused by the presence of the polyalkyleneimines can be ameliorated by the addition of an amphoteric polymer.

Any amphoteric polymer may be used to achieve this effect. Preferably the amphoteric polymer is a hydrophilic polymer.

The protection of the non-metallic inorganic items, such as glassware, ceramic and enamel as demonstrated in WO2010/020765 is unaffected by the addition of the amphoteric polymer, to the polyalkyleneimine containing detergent formulation.

Preferably the amphoteric polymers suitable for use in combination with the polyalkyleneimine preferably include at least (1) an acidic monomer having or capable of forming an anionic charge and (2) a monomer having a permanent cationic charge or is capable of forming a cationic charge upon protonation.

Further, the polymer is preferably an aqueous based acrylic acid amine-functional polymer. An example of such a polymer is a quaternized ammonium acryl amide acrylic acid copolymer. Hydrophilic polymers suitable for inclusion in the composition of the invention are described in U.S. Pat. Nos. 6,569,261, 6,593,288, 6,703,358 and 6,767,410, the disclosures of which are incorporated herein by reference.

These patent documents describe water-soluble or water-dispersible copolymers including, in the form of polymerized units (1), at least one amine-functional monomer (2), at least one hydrophilic monomer with an acidic nature and optionally at least one hydrophilic monomer with ethylenic unsaturation and with a neutral charge (3). The copolymers include quaternized ammonium acryl amide acid copolymers. It will be appreciated that selection of appropriate relevant materials and structures as to the polymer should be guided in more detail by the teachings of these patent documents. A preferred copolymer of the above type is produced by Rhodia and sold under the trade name MIRAPOL SURF S, in particular that sold under the trade name MIRAPOL SURF S P-free powder.

The amphoteric polymer is preferably used in a washing or rinsing cycle in an automatic dishwasher in an amount of from 0.01 mg up to 10 g, more preferably from 0.05 mg up to 5 g, more preferably from 0.1 mg up to 1 g and most preferably from 0.5 mg up to 100 mg per wash or rinse cycle.

It is also possible to use the amphoteric polymer in both the wash and the rinse cycles of an automatic dishwashing machine.

The compositions of the present invention may include the amphoteric polymer from 0.001 to 90 wt %, preferably from 0.005 to 50 wt %, more preferably from 0.01 to 10% by weight.

The term polyalkyleneimine as used herein encompasses any alkyleneimine comprising 2 or more alkyleneimine repeating units, and thus alkyleneimine oligomers, such as ethyleneimine oligomers, are included within the term. Typically the polyalkyleneimine will comprise from 2 to 50,000 alkyleneimine repeating units, preferably 10 to 25,000, such as 50 to 10,000.

Unless otherwise stated or required by the context, all percentages herein are given as weight percentages based on the total weight of the composition. Reference herein to "polyalkyleneimine(s)" includes reference to the salts and/or derivatives thereof. References to "amphoteric polymer(s)" includes reference to the salts and/or derivatives thereof.

The polyalkyleneimine and/or salts or derivatives thereof is used in an effective amount to provide the aforementioned corrosion protection effects during a washing or rinsing cycle. The polyalkyleneimine is preferably used in a washing or rinsing cycle in an automatic dishwasher in an amount of from 0.01 mg up to 10 g more, preferably from 0.05 mg up to 5 g, more preferably from 0.1 mg up to 1 g and most preferably from 0.5 mg up to 100 mg per wash or rinse cycle. It is also possible to use the polyalkyleneimine in both the wash and the rinse cycles of an automatic dishwashing machine.

Most preferably the polyalkyleneimine and amphoteric polymer are part of a detergent or rinse formulation. The detergent formulation may be any common detergent formulation of the type usually employed with automatic dishwashers. The formulation may comprise a liquid, gel, powder or tablet formulation which can be at least partially packed or filled into a water soluble pouch. Similarly a coating may be used to coat at least a portion of the formulation. The mono-dose detergent formulation may be sub-divided with different portions separated from each other.

Where the formulation is a liquid/gel generally the polyalkyleneimine and amphoteric polymer are present in solution within the liquid/gel. However, it is also contemplated to have the polyalkyleneimine and/or amphoteric polymer present in the liquid/gel in the form of an insoluble solid salt/compound so that the polyalkyleneimine and/or amphoteric polymer may comprise a suspended particle (e.g. such as a "speckle" typically found in these formulations). For compositions having a water soluble coating or pouch it is contemplated to have the polyalkyleneimine and/or amphoteric polymer as part of the coating/pouch composition.

The detergent formulation normally comprises other components which are typically found in dishwasher detergent formulations. In this regard the detergent formulation typically comprises one or more components selected from the group comprising surfactants (non-ionic, anionic, cationic and zwitterionic), builders, enzymes, foam suppressants, bleaches, bleach activators, thickeners, perfumes, dyes, corrosion inhibitors.

The polyalkyleneimine and amphoteric polymer may be present in an automatic dishwasher (ADW) detergent composition. In this case the polyalkyleneimine preferably comprises from 0.0001% wt-50% wt of the detergent composition, more preferably from 0.0005% wt-5% wt and most preferably 0.001% wt-1% wt of the dishwasher detergent composition (e.g. 10 mg for a 20 g tablet).

The ADW detergent composition may have a pH from 6-12. The detergent composition may be neutral with a pH from 6-8 or an alkaline formulation with a pH from 8-12, preferably between 9 and 11.

The ADW detergent composition may be phosphate free.

The polyalkyleneimine and amphoteric polymer may be also be included in a rinse aid composition. In this case the rinse aid composition preferably comprises from 0.0005% wt-70% wt of the polyalkyleneimine, more preferably from 0.001% wt-50% wt and most preferably 0.005% wt-25% wt, such as from 0.01% wt-5% wt of the rinse aid composition. The rinse aid composition preferably comprises from 0.0005% wt-70% wt of the amphoteric polymer, more preferably from 0.001% wt-50% wt and most preferably 0.005% wt-25% wt, such as from 0.01% wt-5% wt of the rinse aid composition.

The rinse aid composition may be acidic and may comprise citric acid.

The polyalkyleneimine and amphoteric polymer may be also be included in a water softening salt composition. These are commonly used for the regeneration of the ion exchanger present in an automatic dishwasher. In this case the water softening salt composition preferably comprises from 0.0001% wt-90% wt of the water softening salt composition, more preferably 0.001% wt-50% wt and most preferably 0.005% wt-25% wt such as 0.01 to 10% wt of the water softening salt composition.

The polyalkyleneimine and amphoteric polymer may be included in a machine cleaner/machine additive composition. In either of these cases the composition comprises from 0.0001% wt-90% wt of the amphoteric polymer, more preferably from 0.0005% wt-50% wt of the amphoteric polymer and most preferably 0.001% wt-10% wt of the amphoteric polymer. The composition also comprises from 0.0001% wt-90% wt of the polyalkyleneimine, more preferably from 0.0005% wt-50% wt of the polyalkyleneimine and most preferably 0.001% wt-10% wt of the polyalkyleneimine.

Polyalkyleneimines are commercially available from different suppliers under various trade names e.g. Lugalvan™ P (ex BASF) and Lupasol™ BASF. Polyalkyleneimines are known to have a very widespread range of average molecular weights, from around 100 up to several million, preferably in the range of from about 100 to about 5,000,000 most preferably of from about 250 to 1,000,000, such as from about 400 to about 100,000. The alkylene group, which is preferably a linear or branched chain, may also for example be cyclic. The alkylene group preferably has from 1 to 50 C atoms, more preferably from 2 to 20, such as from 2 to 5, such as ethylene. These polymers can be linear, branched or end capped. Suitable end-caps include alkylenediamines such as $C_2$-$C_5$ alkylenediamines e.g. ethylenediamines. The polymers may be derivatized, e.g. by alkoxylation, ethoxylation, propoxylation protonated, and be provided with or without a counter-ion.

If a counter-ion is present any suitable counter-ion may be used.

If a counter-ion is used which is known to have negative effects in the dishwashing process, e.g. chloride, the chloride counter-ion is preferably present in the dishwashing process at a concentration of less than 200 mg/liter of dishwashing liquor, more preferably at less than 100 mg/liter most preferably less than 50 mg/liter in order to avoid rusting, pitting or other types of corrosion on stainless steel e.g. cutlery.

Common commercially available polyalkyleneimines are usually available as an admixture mixture of one or more of the above species. A solvent such as water may be present. Any one of these species would be suitable for use in the present invention.

The composition is further described, by way of illustration, with reference to the following non-limiting Example.

EXAMPLE

The following base Composition A was utilised in the rinse tests to determine spotting levels.

| Components of Composition A | % wt |
|---|---|
| Sodium Tripolyphosphate | 45.0 |
| Sodium Carbonate | 24.0 |
| Sodium Bicarbonate | 3.0 |
| Citric acid | 1.0 |

-continued

| Components of Composition A | % wt |
|---|---|
| Cellulose | 1.0 |
| Lactose | 1.0 |
| Sodium disilicate | 3.0 |
| Polyethyleneglycol (PEG) | 7.0 |
| Sodium Percarbonate | 10.0 |
| TAED | 2.0 |
| Protease | 0.9 |
| Amylase | 0.4 |
| Non-ionic Surfactant | 1.0 |
| Benzotriazole | 0.2 |
| Perfume + Dye | 0.5 |

Rinse Test Evaluation Data

| Experiments | Composition A 20 grams only | Composition A 20 g + Lupasol ™ 15 mg | Composition A 20 g Lupasol ™ 15 mg + Mirapol Surf S (P-free powder) ™ 50 mg |
|---|---|---|---|
| | Spotting Score Results | | |
| Long drink glasses | 5.7 | 4.0 | 5.0 |
| Whiskey glasses | 6.0 | 4.0 | 5.5 |
| Ventura knives | 4.3 | 4.7 | 4.8 |
| Porcelain plates | 4.9 | 4.1 | 4.6 |
| Melamine Plastic plates | 4.4 | 4.0 | 4.0 |
| PP Bowl | 3.3 | 3.0 | 4.0 |

Base Composition A was tested on its own, with a polyalkyleneimine (Lupasol™) and in combination with both a polyalkyleneimine (Lupasol™) and an amphoteric polymer (Mirapol Surf S (P-free powder)™).

The results show that the addition of an amphoteric polymer improves the spotting performance of the combination of the detergent composition with the polyalkyleneimine.

Glassware protection was maintained with the addition of the amphoteric polymer.

Rinse Test Method Details

Test method: R206V1

Machine: Bosch SGS058M02EU/36

Program: Eco 50° C.+Various Speed (No 3 in 1 function)

Water Hardness: 21° GH

Evaluators: 1 trained person.

Spotting Scores

| Score | Result |
|---|---|
| 10 | No streaks and spots |
| 9 | Few slight streaks and/or a few small spots |
| 8 | Some slight streaks and/or some small spots |
| 7 | Several slight streaks and/or a few medium size spots |
| 6 | Some moderate streaks and/or medium size spots |
| 5 | Moderate streaks and/or a few big spots |
| 4 | Some strong streaks and/or many big spots |
| 3 | Strong streaks and/or many big spots |
| 2 | Very strong streaks and/or numerous big spots |
| 1 | Whole surface is covered with very strong streaks and/or spots |

While several possible embodiments are disclosed above, embodiments of the present invention are not so limited. For instance, while there are several possible configurations of materials for the composition comprising a polyalkyleneimine and at least one amphoteric polymer, and methods for automatic ware washing using said composition in automatic ware washing machines have been disclosed, as well as other methods of use of the disclosed compositions, other suitable materials and combinations of materials, as well as steps in automatic ware washing or other methods of use, could be selected without departing from the spirit of embodiments of the invention. Such changes are intended to be embraced within the scope of the invention.

The specific configurations, choice of materials, method steps, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

The invention claimed is:

1. A method of automatic dishwashing, comprising:

supplying a composition to an automatic dishwashing machine; and washing wares in the machine, wherein the composition comprises a polyethyleneimine and/or salts thereof and at least one amphoteric polymer, wherein the amphoteric polymer is a water-soluble or water-dispersible copolymer including, in the form of polymerized units, at least one monomer having an amine functional group and at least one hydrophilic acidic monomer, wherein the composition is an alkaline automatic dishwashing detergent composition with a pH from 8 to 12, wherein the method results in good rinse performance, wherein the composition is phosphate free, wherein the number average molecular weight of the polyethyleneimine and/or salts thereof is in the range of 100 to 5,000,000, and wherein the polyalkyleneimine is in an amount of 0.0001 to less than 0.1 wt % of the composition, and the amphoteric polymer is in an amount between 0.01 to less than about 4 w % of the composition.

2. The method according to claim 1, wherein the at least one amphoteric polymer is a hydrophilic polymer.

3. The method according to claim 2, wherein the hydrophilic polymer is an aqueous based acrylic acid amine-functional polymer.

4. The method according to claim 2, wherein the hydrophilic polymer is a quaternized ammonium acrylamide acrylic acid copolymer.

5. The method according to claim 1, wherein the composition is provided in monodose form.

6. The method according to claim 1, comprising washing glassware in the automatic dishwasher.

7. The method according to claim 1, wherein the composition is released into a wash cycle of the machine.

8. The method according to claim 1, wherein the composition has a pH from 9 to 11.

* * * * *